US011371680B1

(12) United States Patent
Rajasekaran

(10) Patent No.: US 11,371,680 B1
(45) Date of Patent: Jun. 28, 2022

(54) LAMP WITH CLAMPING BASE

(71) Applicant: E. MISHAN & SONS, INC., New York, NY (US)

(72) Inventor: Mohan Rajasekaran, Watertown, CT (US)

(73) Assignee: E. Mishan & Sons, Inc., New York, NY (US)

( * ) Notice: Subject to any disclaimer, the term of this patent is extended or adjusted under 35 U.S.C. 154(b) by 0 days.

(21) Appl. No.: 17/538,209

(22) Filed: Nov. 30, 2021

Related U.S. Application Data

(63) Continuation-in-part of application No. 29/814,250, filed on Nov. 4, 2021.

(51) Int. Cl.

| | |
|---|---|
| ***F21V 21/088*** | (2006.01) |
| ***F21L 4/02*** | (2006.01) |
| ***F21V 21/14*** | (2006.01) |
| ***F21V 23/04*** | (2006.01) |
| ***F21Y 115/10*** | (2016.01) |

(52) U.S. Cl.
CPC ..... *F21V 21/0885* (2013.01); *F21L 4/02* (2013.01); *F21V 21/145* (2013.01); *F21V 23/0414* (2013.01); *F21Y 2115/10* (2016.08)

(58) Field of Classification Search
CPC ..... F21V 21/0885; F21V 21/145; F21V 23/0414; F21V 21/32; F21L 4/02; F21Y 2115/10
See application file for complete search history.

(56) References Cited

U.S. PATENT DOCUMENTS

| | | | | |
|---|---|---|---|---|
| 7,481,554 | B2 * | 1/2009 | Anderson | F21L 4/04 362/411 |
| 8,568,009 | B2 * | 10/2013 | Chiang | A01K 63/06 362/249.05 |
| 9,206,951 | B2 * | 12/2015 | McLennan | F21L 4/04 |
| 10,731,834 | B1 * | 8/2020 | Cope | F21V 21/0885 |
| 2012/0195025 | A1 * | 8/2012 | Gerolemou | F21V 21/145 362/103 |

OTHER PUBLICATIONS

Web printout of Indoorgardening.com, retrieved Nov. 18, 2021.

* cited by examiner

*Primary Examiner* — Peggy A Neils
(74) *Attorney, Agent, or Firm* — Notaro, Michalos & Zaccaria P.C.

(57) ABSTRACT

A portable or landscape lamp or luminaire for illumination, decorative lighting, or lighting to encourage the growth of plants, consists of a clamping base including a housing for device electronics, a control panel disposed on an outer surface of the clamping base for receiving user input, and a plurality of a gooseneck lamps supported by the clamping base and having LEDs for selectively emitting light under the control of the device electronics as directed by the user input through the control panel.

10 Claims, 7 Drawing Sheets

LAMP WITH CLAMPING BASE

CROSS REFERENCE TO RELATED APPLICATIONS

This application is a continuation-in-part of U.S. patent application Ser. No. 29/814,250, filed Nov. 4, 2021, which is incorporated by reference herein for all purposes.

FIELD AND BACKGROUND OF THE INVENTION

The subject technology relates to electric lighting devices or lamps.

SUMMARY OF THE INVENTION

According to an aspect of the subject technology, a portable or landscape lamp or luminaire for illumination, decorative lighting, or lighting to encourage the growth of plants, has a clamping base comprising a first jaw having a first end portion and a second end portion, and a second jaw having a first end portion and a second end portion, the second jaw pivotably attached to first jaw at a point of attachment adjacent to the first end portions of the upper and second jaws, and a spring disposed and biased to pivot the second jaw with respect to the first jaw so that the second end portion of the second jaw is urged toward contact with the second end portion of the first jaw, thereby forming a clamp for removably attaching the clamping base; device electronics disposed within the first jaw or second jaw; a control panel disposed on an outer surface of the first jaw or second jaw for receiving user input;

a gooseneck support having a first end and a second end, the first end attached to the first jaw or second jaw, the second end attached to an illumination unit; the illumination unit comprising an illumination housing having an opening formed therein, and light emitting devices disposed within the illumination housing and disposed to emit light through the opening; an electric power source disposed on the first jaw or second jaw; electrical wiring extending through the gooseneck support and connecting the device electronics to the light emitting devices; the device electronics, control panel, power source, electrical wiring, and light emitting devices electrically and operatively connected to selectively operate the light emitting devices as directed by the user input.

The various features of novelty which characterize the subject technology are pointed out with particularity in the claims annexed to and forming a part of this disclosure. For a better understanding of the subject technology, its operating advantages and specific objects attained by its uses, reference is made to the accompanying drawings and descriptive matter in which preferred embodiments of the subject technology are illustrated.

DETAILED DESCRIPTION OF THE INVENTION

Figure 1:
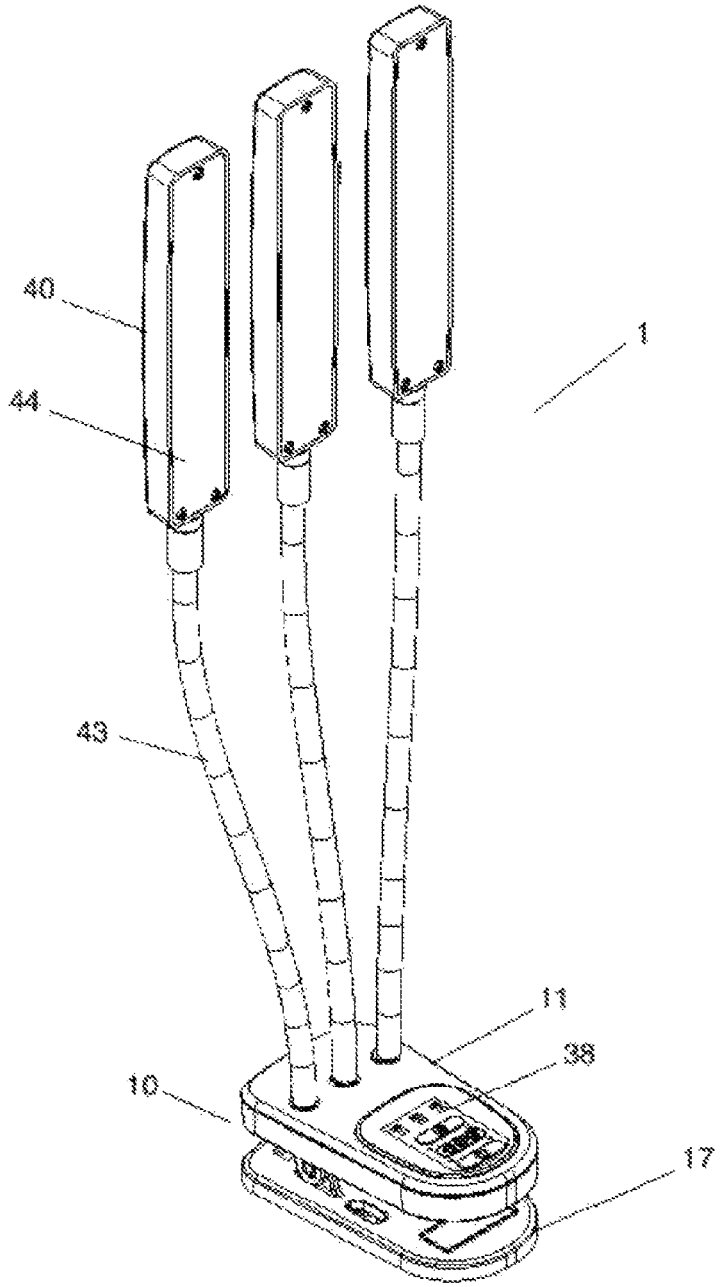
FIG. 1 is a perspective view of a lamp according to a non-limiting embodiment of the subject technology.
Figure 2:
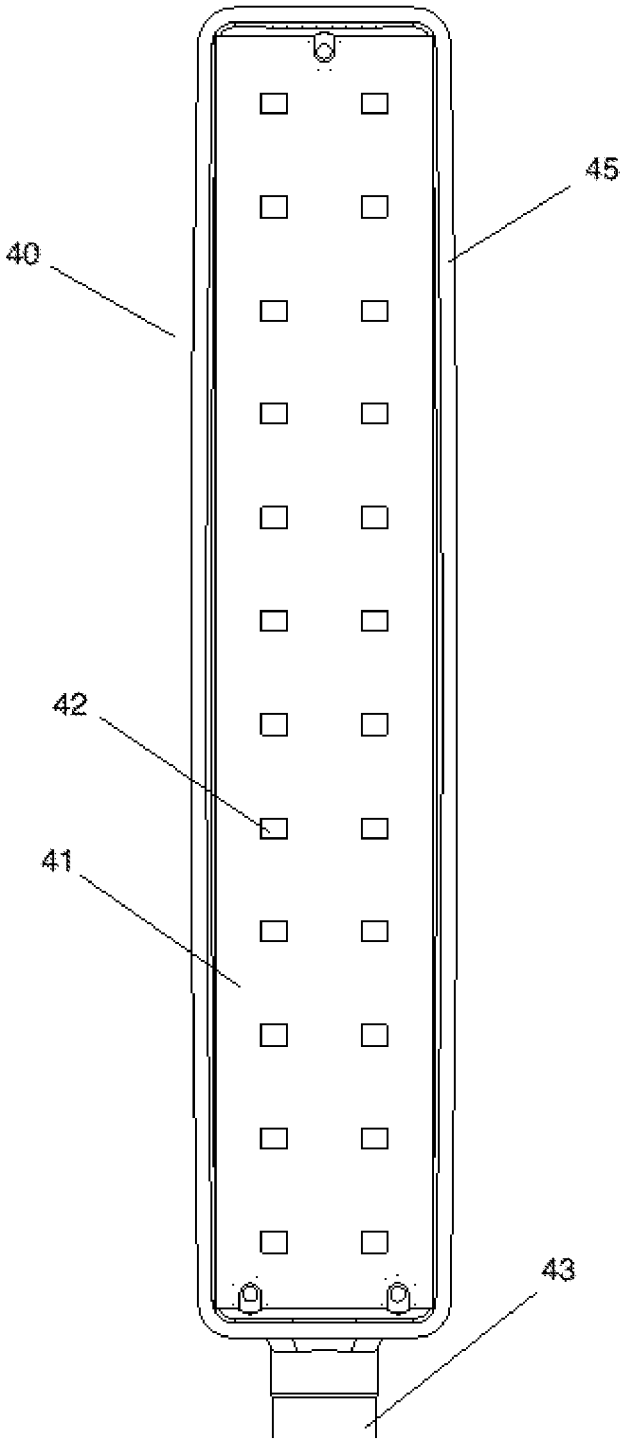
FIG. 2 is a view of an illumination unit of the non-limiting embodiment of FIG. 1, with the lens removed to reveal the PCB and LEDs.
Figure 3:
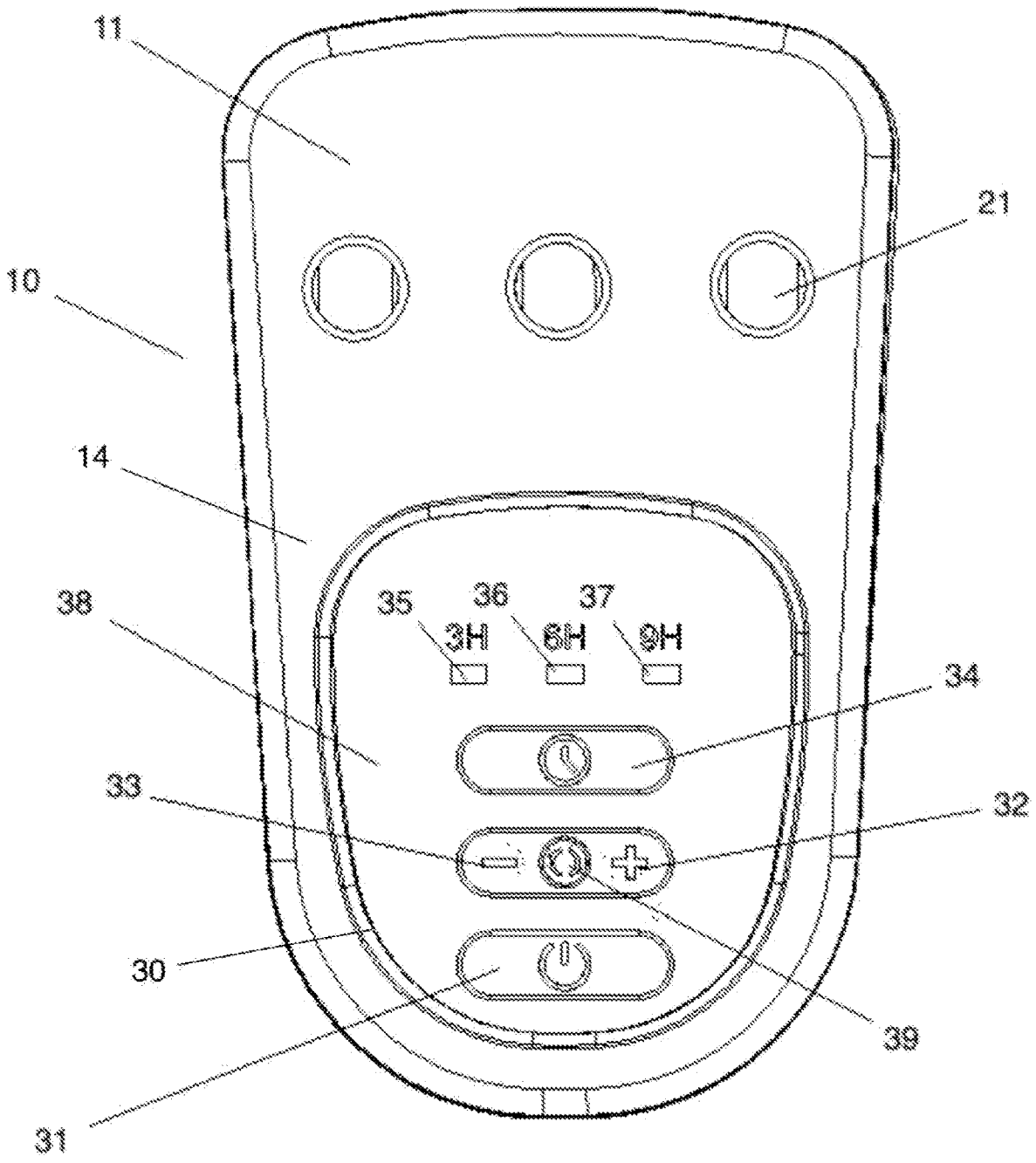
FIG. 3 is a top view of the clamping base of the non-limiting embodiment of FIG. 1, with the gooseneck supports removed.
Figure 4:
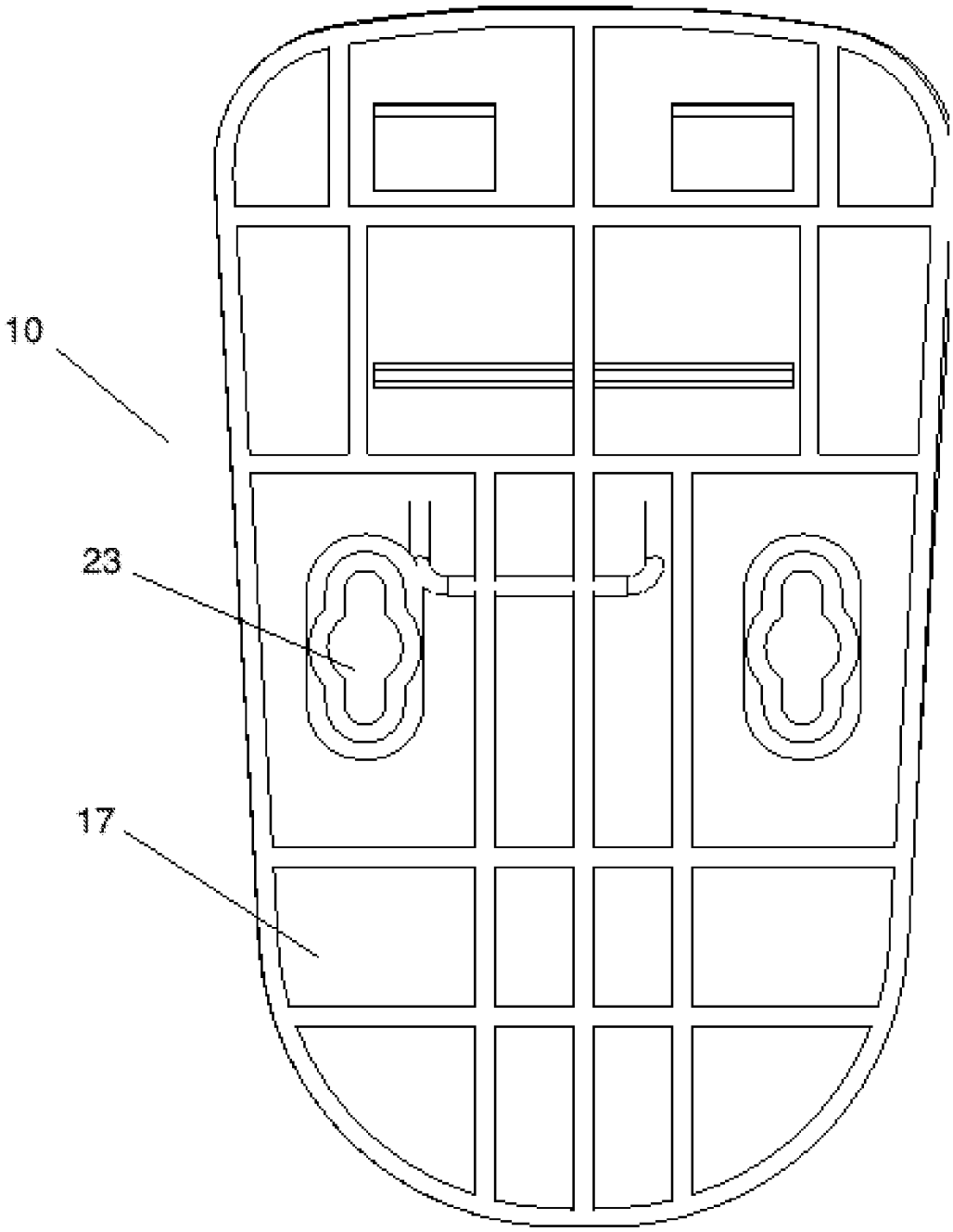
FIG. 4 is a bottom view of the clamping base of the non-limiting embodiment of FIG. 1.
Figure 5:
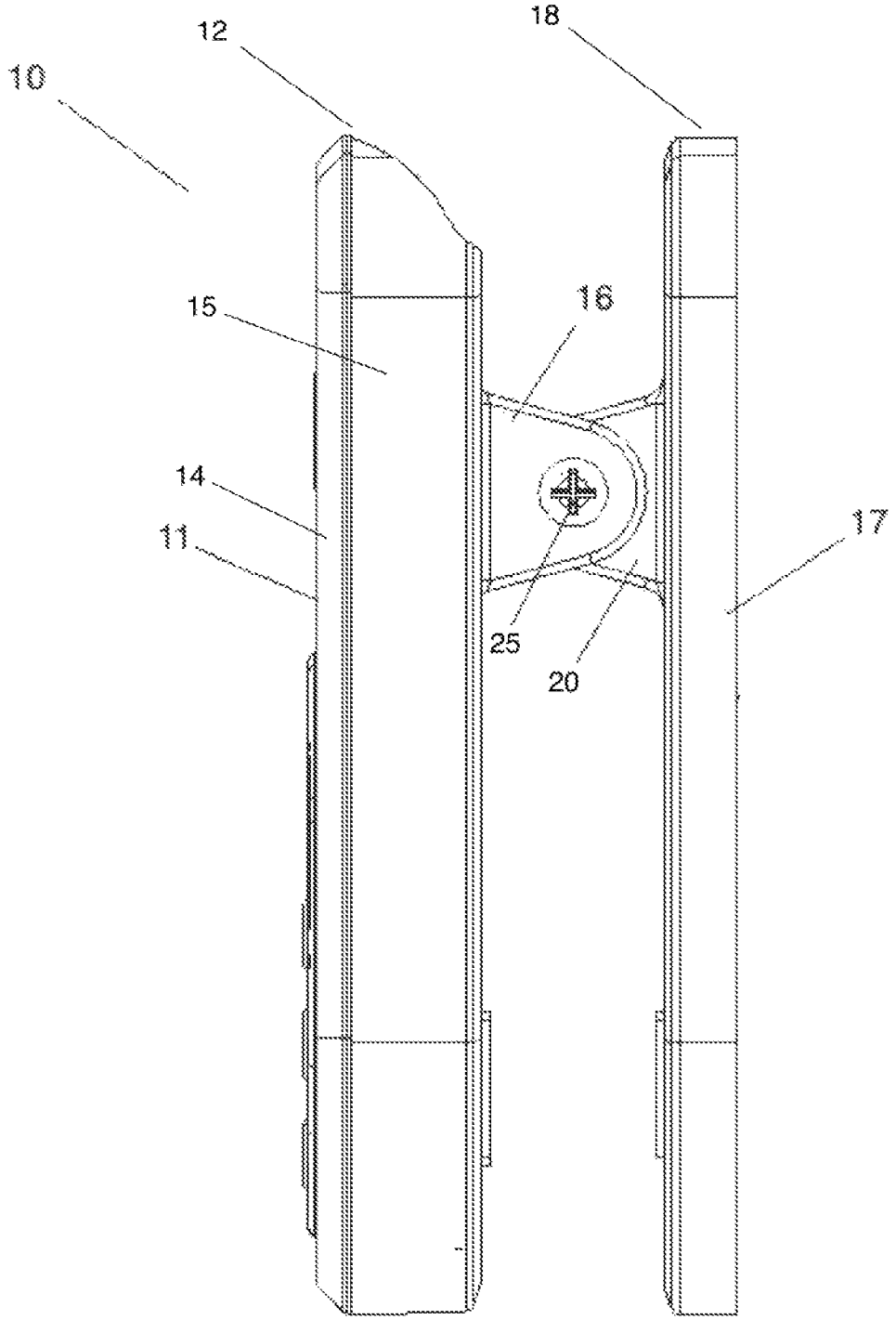
FIG. 5 is a right-side view of the clamping base of the non-limiting embodiment of FIG. 1.
Figure 6:
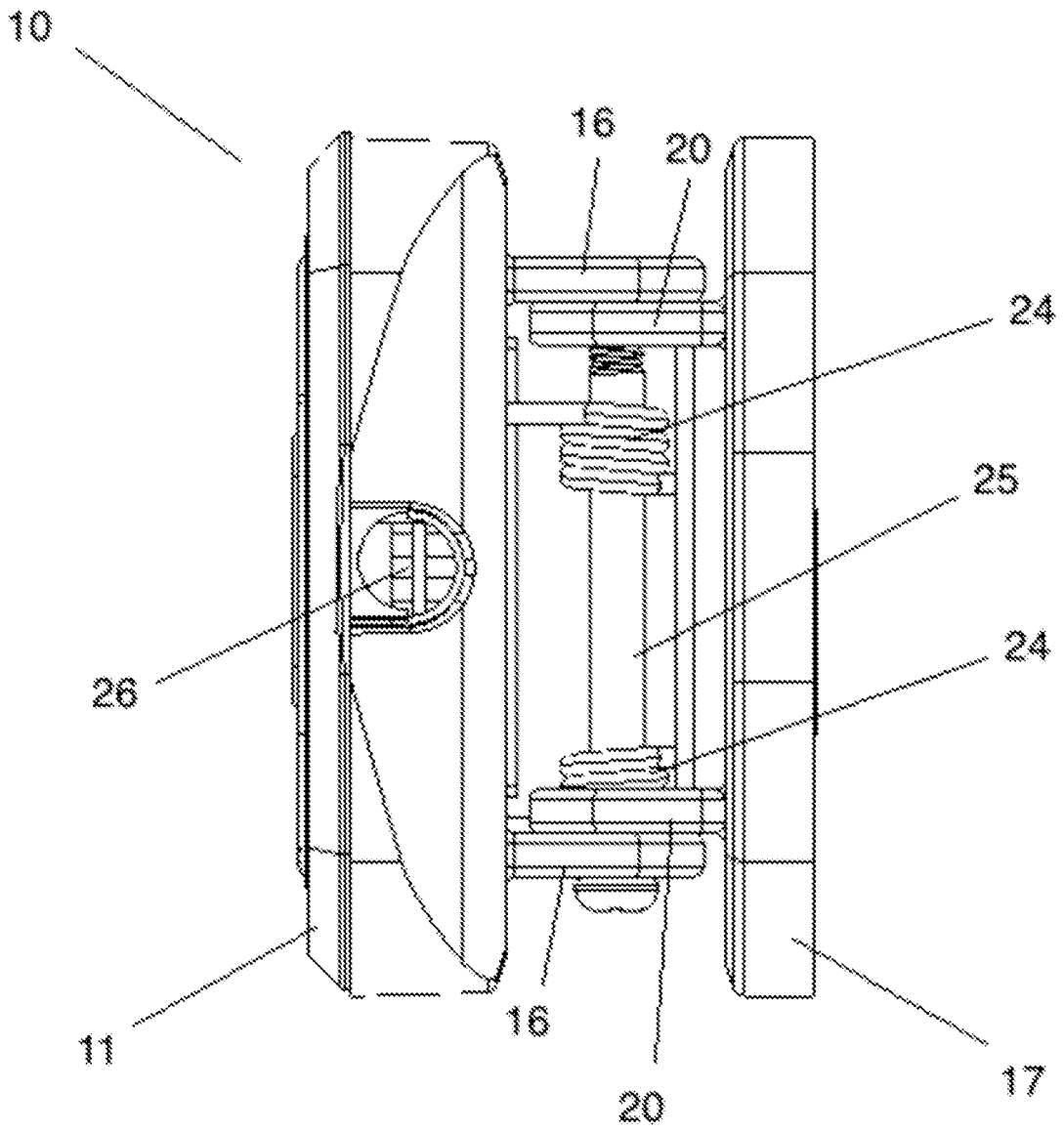
FIG. 6 is a front view of the clamping base of the non-limiting embodiment of FIG. 1.
Figure 7:
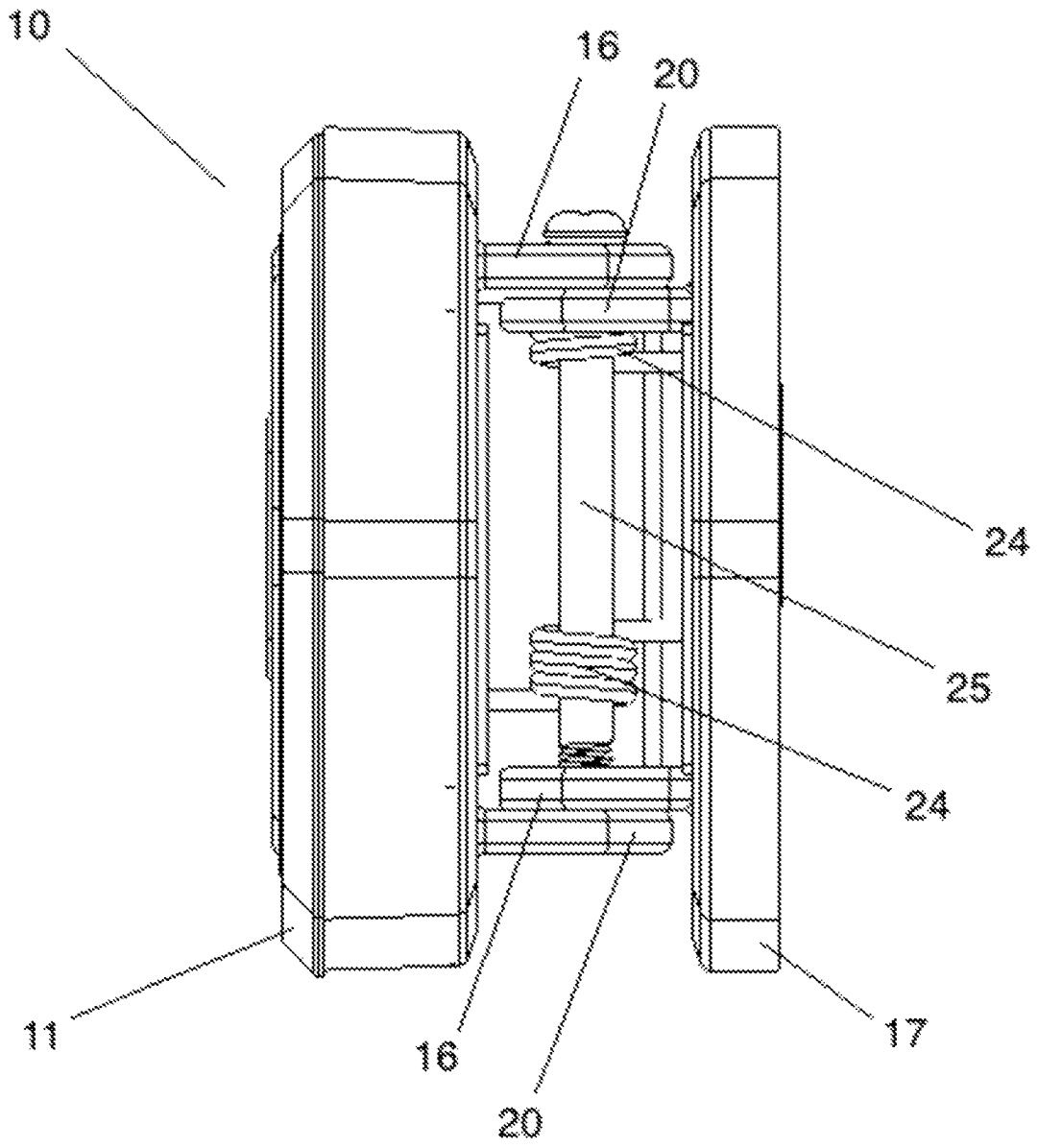
FIG. 7 is a rear view of the clamping base of the non-limiting embodiment of FIG. 1.

According to an aspect of the subject technology, as shown in Figures, lamp 1 comprises clamping base 10 and one or more illumination units or lamp units 40 attached to base 10 via respective gooseneck supports 43.

In a non-limiting embodiment, clamping base 10 has the following structure. Upper jaw 11 is hingedly attached to lower jaw 17, at an attachment point near a first end 12, 18 of the jaws. The hinged attachment of the jaws is accomplished by knuckles 16, 20 disposed on the inner surfaces of jaws 11, 17, with hinge pin 25 joining the respective knuckles 16, 20 to form the hinged attachment. A spring 24 is disposed between jaws 11, 17 and is biased to pivot lower jaw 17 with respect to the upper jaw 11, so that a second end portion 19 of the lower jaw 17 is urged toward contact with the second end portion 13 of upper jaw 11, thereby forming a spring clamp for removably attaching the clamping base to a substrate such as a tabletop, shelf, door, or similar support. Lower jaw 17 may include mounting through-holes 23 for attaching lamp 1 to a substrate by screws or similar fasteners.

In a non-limiting embodiment, upper jaw 11 is hollow and is formed of an upper housing 14 attached to lower housing 15 to result in a hollow compartment therebetween. Openings 21 are provided in upper housing 14 for attachment of hollow gooseneck supports 43. Device electronics 30 are disposed within the hollow compartment of upper jaw 11, and are programmed, configured and adapted to operate the functions of lamp 1 as will be hereinafter described.

Illumination units 40 are each connected by a respective hollow gooseneck 43 to base 10. Each illumination unit 40 comprises a unit housing 45 for containing the operative components of illumination unit 40. Unit housing 45 is open on one side for exposing the light emitting devices 42, for example high-power LEDs disposed and supported on a printed circuit board ("PCB") 41. A transparent or translucent lens 44 is disposed over the opening of housing 45. Wiring passes through each of the hollow goosenecks 43, to base 10 through openings 21, and is connected to the device electronics 30, to electrically and operably connect the light emitting devices 42 on PCBs 41 with the device electronics. An illumination unit 40 and its PCB 41 and LEDs 32, its attached gooseneck support 32, and associated wiring, constitutes a gooseneck lamp attached to the clamping base 10. The illumination units 40 shown in the figures are long and rectangular, but in other embodiments they are square, triangular, hexagonal, round, in an irregular shape, or any other shape.

In an embodiment, user control panel 38 is disposed on an outer surface of upper jaw 11 and includes buttons or switches, for example a membrane keypad, for user operation of the functions of lamp 1 as will be hereinafter described. User control panel 38 is electrically and operatively connected to the device electronics 30 for user control of the device electronics.

In an embodiment, power socket 26 is provided in upper jaw 11 for connection of an external DC electric power supply (not shown) for powering the electrical components of lamp 1. In an alternative embodiment, the compartment of upper jaw 11 contains a rechargeable battery electrically and operatively connected to device electronics 30 for powering lamp 1 when not connected to an external power supply. In another alternative embodiment, the rechargeable battery is provided, along with solar cells disposed on an outer surface of lamp 1 and operatively connected to device electronics 30 and the rechargeable battery for harvesting solar energy and recharging the battery.

In an embodiment of lamp 1, the controls disposed on control panel 38 are as follows. Power button 31 is operable to toggle the state of lamp 1 on and off, when pressed. A multi-function membrane button 32, 33, 39 has three functions, which are, to increase the brightness of the light emitting devices 42 when button 32 is pressed, to decrease the brightness of the light emitting devices 42 when button 33 is pressed, and to change the color of light emitted by light emitting devices 42 when button 39 is pressed. Timer button 34 is pressed to trigger a timed lighting function of lamp 1.

More specifically, in an embodiment, pressing power button 31 and holding for two seconds toggles lamp 1 between the OFF state and the ON state. Pressing power button 31 and holding for less than two seconds, i.e. tapping power button 31, cycles the number of illumination units that will be powered on in the ON state, specifically in the embodiment shown, three illumination units powered on, then two illumination units powered on, then one illumination unit powered on, then the cycle repeats with three illumination units powered on. Each tap of power button 31 advances the cycle one step.

In an embodiment, pressing color change button 39 cycles the light color emitted by light emitting devices 42, specifically, each press of color change button 39 advances the cycle one step. In an embodiment, the color cycle comprises purple light (i.e., light emitting devices 42 emitting red light and blue light), then blue light, then red light, then the cycle repeats with purple light.

In an embodiment, lamp 1 has six levels of relative brightness of the light emitted by light emitting devices 42, and each tap of button 32 increases the level of brightness (up to the maximum level), while each tap of button 33 lowers the level of brightness (down to the minimum level).

In an embodiment, pressing timer button 34 cycles the timed lighting function of lamp 1, as follows. When lamp 1 is first turned on by operation of power button 31, lamp 1 will stay in the ON state for an indefinite period of time. This behavior can be modified by operation of timer button 34. Each tap of button 34 cycles the time limit, setting a time period after which lamp 1 will revert to the OFF state. The time limit cycle is as follows: three hours, six hours, nine hours, time limit off (i.e., the lamp 1 will remain ON indefinitely), then the cycle repeats. The time limits all run from the last tap of button 34. The respective LEDs 35, 36, 37 are illuminated selectively by the control electronics 30 to indicate the time limit cycle in effect. Thus, from the initial ON position, a first tap of button 34 will set the time limit to be three hours from the tap, and only LED 35 is illuminated; a second tap of button 34 will set the time limit to be six hours from the tap, and only LED 36 is illuminated; a third tap of button 34 will set the time limit to be nine hours from the tap, and only LED 37 is illuminated; a third tap of button 34 will disable the time limit, and none of LEDs 35, 36, 37 are illuminated.

In an embodiment, the LEDs 37 are selected and driven to emit light which encourages plant growth (i.e. a "grow light"). For example, LEDs 37 may be "full spectrum" LEDs, or other LEDs which emit grow light.

It should be understood that the ornamental appearance of the lamp and components thereof as shown in the Figures are within the scope of the subject technology.

While specific embodiments of the invention have been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention.

What is claimed is:

1. A lamp comprising:

a clamping base comprising a first jaw having a first end portion and a second end portion, and a second jaw having a first end portion and a second end portion, the second jaw pivotably attached to first jaw at a point of attachment adjacent to the first end portions of the first and second jaws, and a spring disposed and biased to pivot the second jaw with respect to the first jaw so that the second end portion of the second jaw is urged toward contact with the second end portion of the first jaw, thereby forming a clamp for removably attaching the clamping base;

device electronics disposed within the first jaw or second jaw;

a control panel disposed on an outer surface of the first jaw or second jaw for receiving user input;

a plurality of gooseneck lamps attached to the base, each gooseneck lamp comprising a gooseneck support having a first end and a second end and being flexible, the first end attached to the first jaw or second jaw, the second end attached to an illumination unit, the illumination unit comprising an illumination housing having an opening formed therein, and light emitting devices disposed within the illumination housing and disposed to emit light through the opening, the light emitting devices selected and driven to emit a plurality of different colors under the control of the device electronics, and electrical wiring extending through the gooseneck support and connecting the device electronics to the light emitting devices in the illumination housing;

an electric power source disposed on the first jaw or second jaw;

and a first button, a second button, a third button, and status LEDs disposed on the control panel;

the device electronics, control panel, first button, a second button, a third button, status LEDs, power source, and electrical wiring operatively connected to the light emitting devices to selectively operate the light emitting devices as directed by the user input, wherein:

(a) the first button is a power button, pressing and holding down the power button for a predetermined period of time toggles the lamp between an OFF state in which none of the gooseneck lamps are powered on and an ON state in which at least one of the gooseneck lamps are powered on, and pressing and holding down the power button for less than the predetermined period of time causes a change in the number of gooseneck lamps which are illuminated on the ON state;

(b) the second button is a color change button, pressing and releasing the color change button causes a change of the color of the light emitted by the light emitting devices;

(c) the third button is a timer button, pressing and releasing the timer button causes a change of a length of time for which the lamp will remain in the ON state before reverting to the OFF state, and the status LEDs are selectively illuminated to indicate the length of time.

2. The lamp of claim 1 further comprising a fourth button and a fifth button, the fourth button and a fifth button disposed on the control panel, wherein pressing the fourth button or fifth button causes a change of a brightness level of the light emitting devices when the lamp is in the ON state.

3. The lamp of claim 2 wherein the fourth button and fifth button are associated with the second button.

4. The lamp of claim 2 wherein the fourth button is adjacent a first side of the second button and the fifth button is adjacent a second side of the second button opposite the first side.

5. The lamp of claim 1 wherein the change the color of the light caused by pressing and releasing the color change button is a cycle having discrete steps.

6. The lamp of claim 5 wherein the cycle of discrete steps is purple light, then blue light, then red light, then the cycle repeats with purple light.

7. The lamp of claim 1 wherein the change of the length of time is a cycle having discrete steps.

8. The lamp of claim 7 wherein the cycle of discrete steps is three hours, six hours, nine hours, time limit off, then the cycle repeats with three hours.

9. The lamp of claim 8 wherein the status LEDs comprise a first status LED which is illuminated only when the length of time is three hours, a second status LED which is illuminated only when the length of time is six hours, and a third status LED which is illuminated only when the length of time is nine hours.

10. The lamp of claim 1 wherein the change in the number of gooseneck lamps which are illuminated on the ON state is a cycle having discrete steps.

* * * * *